United States Patent [19]

Abler et al.

[11] 4,236,286

[45] Dec. 2, 1980

[54] MANUFACTURE OF KNITTED SYNTHETIC FUR FABRIC

[75] Inventors: Norman C. Abler, Menomonee Fall; Earlyn E. Zimmerman, Jefferson; Wayne A. Swihart, Elkhorn, all of Wis.

[73] Assignee: Borg Textile Corporation, Oak Brook, Ill.

[21] Appl. No.: 911,467

[22] Filed: Jun. 1, 1978

[51] Int. Cl.[3] ..... D06C 23/00

[52] U.S. Cl. ..... 28/160; 26/16; 66/9 B; 66/191; 66/194

[58] Field of Search ..... 28/160; 26/2 R, 2 E, 26/16; 66/9 B, 191, 194

[56] References Cited

U.S. PATENT DOCUMENTS

| | | | |
|---|---|---|---|
| 2,737,702 | 3/1956 | Schmidt et al. | 28/160 X |
| 2,815,558 | 12/1957 | Bartories et al. | 28/160 X |
| 2,875,504 | 3/1959 | White | 28/160 X |
| 3,010,179 | 11/1961 | Thal | 28/160 |
| 3,299,672 | 1/1967 | Schmidt | 66/191 X |
| 3,590,604 | 7/1971 | Beucus et al. | 66/191 |
| 3,894,407 | 7/1975 | Clingan et al. | 66/9 B |
| 4,102,023 | 7/1978 | Abler | 26/16 |

FOREIGN PATENT DOCUMENTS

| | | | |
|---|---|---|---|
| 138002 | 7/1950 | Australia | 28/160 |
| 2544868 | 4/1976 | Fed. Rep. of Germany | 66/194 |
| 2451806 | 10/1976 | Fed. Rep. of Germany . | |
| 1234170 | 5/1960 | France . | |
| 1596436 | 7/1970 | France . | |
| 793699 | 4/1958 | United Kingdom | 28/160 |
| 931401 | 7/1963 | United Kingdom | 28/160 |
| 1059197 | 2/1967 | United Kingdom . | |
| 1163524 | 9/1969 | United Kingdom . | |

OTHER PUBLICATIONS

*High Pile Fabric Knitting and Finishing Review,* Canadian Textile Journal, Mar. 1958, pp. 51, 52, 53.

*Pile Fabrics,* by Daniel Frishman, reprinted from Textile Industries, copyright 1964–1965, pp. 12–18.

*Sliver-Knitted Pile Fabrics in Terylene,* The Textile Manufacturer, Jul. 1970, pp. 288, 289, 290.

*Primary Examiner*—Robert Mackey

*Attorney, Agent, or Firm*—Hill, Van Santen, Steadman, Chiara & Simpson

[57] ABSTRACT

Process technology is provided for making a synthetic fur piece from a sliver knit, high pile, differentially transversely knitted, longitudinally patterned, unstabilized starting fabric having a pile containing heat shrinkable fibers. The process involves stabilizing the starting fabric, contour shearing same, and then further processing the resulting sheared fabric under conditions which result in heat shrinking of the heat shrinkable pile fibers therein. The preferred product is a synthetic fur piece comprised of seemingly seamed together animal pelts. Various finishing operations typically and preferably are performable upon such a product to enhance fur-like properties and to simulate the appearance and qualities of specific desired animal furs, such as, for example, mink.

12 Claims, 14 Drawing Figures

MANUFACTURE OF KNITTED SYNTHETIC FUR FABRIC

BACKGROUND OF THE INVENTION

Knitted pile fabrics made on circular knitting machines have become well known, and efforts have previously been made to produce synthetic fur pieces comprised of fabric knitted on a circular knitting machine. So long as the product synthetic fur piece so knitted has a uniform texture, it was possible by prior art technology to produce simulated fur products which have reasonable aesthetic appearance, excellent wear properties, and commercial practicality.

However, when it is desired to closely simulate in a deep pile fabric made on a circular knitting machine a synthetic fur piece comprised of seemingly seamed together animal pelts wherein the individual pelts are longitudinally aligned relative to one another, have individually discernible, predetermined Gratzens, and have non-uniform textures (including fur fiber length variations), severe manufacturing problems arise which heretofore had no practical solutions. For one thing, to make such a synthetic fur piece, it is necessary to have the pile fiber blend vary systematically (as respects not only color, but also fiber type and local content) by a predetermined program extending from fabric wale to wale during the knitting operation in order to simulate the actual variations which occur in pelt characteristics. For another thing, it is necessary to use fabric blends which can be subsequently processed preferably in a continuous or semi-continuous manner following the actual knitting operation so as to produce a product processed fabric resembling such a desired synthetic fur piece whose exterior surface portions (or pile) varies in local density and is comprised of fibers of variable color, length and thickness, thereby to simulate an actual predetermined animal fur.

Modern circular knitting machines are designed to provide the capability of knitting complex pile patterns through the use of electromechanical and mechanical systems which can be computer controlled so that systematic pile pattern variations from wale to wale, suitable for the use in manufacturing synthetic fur pieces, can be achieved. However, such a knitting manufacturing capability does not begin to solve the problem of manufacturing fabrics resembling such a synthetic fur piece because of the necessity to perform subsequent processing thereupon.

Thus, in the deep pile knitted fabric art, for practical purposes, it is generally considered necessary to coat or impregnate the back of a knit product with some sort of coating composition which, typically with subsequent heating, tends to render the product fabric dimensionally stable, and also to give it durability by bonding the individual tufts of pile fiber into the substrate backing so that the product does not shed very easily, and so that the individual pile fibers are not easily plucked out of the stitches of the fabric backing.

In the case of synthetic fur fabrics with non-uniform transverse characteristics, it is desirable to employ a knitted deep pile fiber blend which utilizes, as a portion thereof, heat shrinkable fibers which heat shrink longitudinally within specified temperature ranges. Through the use of such heat shrinkable fibers, combined with suitable processing, it becomes possible to produce a product synthetic fur piece wherein the individual fibers of the pile have differential lengths, such as is characteristic of virtually all animal pelts. A problem arises in dimensionally stabilizing a freshly knit pile fabric through back coating because coating compositions commonly require subsequent application of elevated temperatures which are in the range of the temperatures employed for accomplishing heat shrinking of heat shrinkable fibers. Obviously, if the heat shrinkable fibers in a deep pile fabric are heat shrunk at an undesirable point in the manufacture of a synthetic fur piece, it is not possible to complete a sequence of post-knitting processing steps needed to complete the manufacture of a pelted fabric.

In addition, in the manufacture of knitted fabrics resembling natural fur pelts, it is desirable to contour shear the surface of the deep pile thereof so that its surface contour has the appearance of sewn together animal pelts of variable fur depth, as is typical of whatever type of animal fur one is trying to mimic in a given product fabric.

It was previously possible to accomplish uniform shearing of knitted fabrics in a continuous manner by passing of pre-formed deep pile knitted fabric beneath a rotating cylindrical member whose circumferential face has portions thereof so contoured that a desirable shearing is accomplished in such a pre-formed fabric. Rotating blades are located along the circumferential surfaces of the rotating cylindrical member, and, when it rotates, it cuts against a stationary knife very much in the manner of operation of a conventional type reel lawn mower. Typically, in the deep pile fabric manufacturing art, the actual knives associated with the rotating cylindrical member are put in at an angle so that, instead of just shearing, they also cut. To accomplish this action, the cross section through the knives typically presents an angle of knife cutting relative to the stationary blade, or so-called ledger blade, whereas, on a reel type lawn mower, the knives are typically almost sectioned so that individual blades pass substantially through the center of the arbour. At any rate, the rotating arbour has, in the cylindrical member employed for deep pile fabric processing, a plurality of cutting edges on it which rotate past, and in close proximity to, and even in some applications actually contact, a fixed ledger blade.

In such uniform shearing, the distance of the rest from the ledger blade was, until recently, held constant, and determined the length of the pile, which was thus always uniform. A recent invention provides a contoured rest of cylindrical shearing apparatus so that different predetermined portions of the pile of a fabric are spaced farther from the arbour and the ledger blade by the use of such a contoured rest during a shearing operation, thereby making it possible to contour shear a deep pile fabric differentially in a direction extending transversely across the fabric relative to the direction of fabric movement through such contour shearing apparatus. Such a contour shearing apparatus is shown in Norman C. Alber U.S. application Ser. No. 719,017, filed Aug. 30, 1976, now U.S. Pat. No. 4,102,023, granted July 15, 1978.

During contour shearing of a patterned deep pile fabric which has been stabilized, the fabric is registered and aligned with the contour shearing apparatus so as to control location of contour shearing relative to the pattern in the fabric. In order to be continuously contour sheared, a patterned deep pile fabric of a type and quality suitable for use in making fabrics resembling natural fur pelts must be sufficiently dimensionally stable to experience processing through such a contour shearing apparatus. If a deep pile fabric being contour sheared is insufficiently dimensionally stable, a regular pattern repeat is not achieved where it is desired in relation to the contour shearing. An Abler contour shear rest is a passive element, in effect, so that a fabric moves over it, in a continuous shearing operation, and conforms to the contour of the rest. Thus, one must first not only dimensionally stabilize and lock the pile into the backing of a given deep pile sliver knit fabric to be contour sheared, but also achieve such a dimensional stabilization without causing the heat shrinkable fiber of the pile to shrink.

So far as is known, no one has heretofore succeeded in producing a sliver knit pile fabric product comprising of seemingly seamed together animal pelts which fabric product has undergone contour shearing in good register prior to heat shrinking of pile fibers contained therein.

BRIEF SUMMARY OF THE INVENTION

The present invention provides in one aspect a deep pile knitted fabric product which has been contour sheared yet which has at least two different lengths of fibers in the pile thereof.

In another aspect, this invention provides a simulated fur piece comprising seemingly seamed together animal pelts. Each pelt of such simulated fur piece has a Gratzen extending generally centrally and longitudinally therethrough which Gratzen is commonly darker in color and thicker in texture than adjoining pelt areas thereof. Also, each such pelt has simulated guard hairs and simulated body hairs, such as are common to real pelts derived from natural fur bearing animals.

In another aspect, the present invention provides a process for making such knitted fabric products. The process employs as a starting material a high pile, unstabilized starting fabric which is preferably differentially transversely sliver knit, and preferably longitudinally patterned. Such pile contains heat shrinkable fibers. By the process, such a starting fabric is dimensionally stabilized without appreciably heat shrinking the heat shrinkable pile fibers, contour sheared, and finally heated to heat shrinkable pile fiber heat shrinking temperatures.

Other and further objects, purposes, advantages, aims, utilities, features and the like will be apparent to those skilled in the art from a reading of the present specification taken together with the drawings.

DETAILED DESCRIPTION

Figure 1:
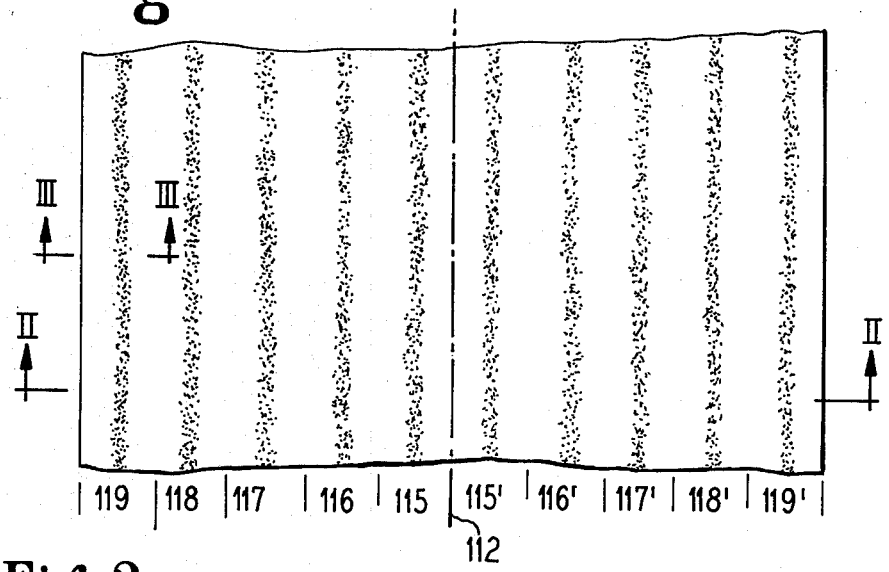
FIG. 1 is a diagrammatic plan view of one embodiment of a starting fabric usable in the practice of the present invention.

In a first step, one tensions both transversely and longitudinally a previously dimensionally unstabilized, knitted (preferably sliver), pile starting fabric. The amount of the expansion through tensioning in any given case can vary. Compared to the relaxed starting fabric, one typically expands the length thereof from 0 to about 30%, and changes the width thereof from about −30% to +30%. Compared to the untensioned starting fabric, the resulting tensioned fabric has been expanded in either the length or the width thereof to a minimum extent of at least about 10%. Preferably equal expansion longitudinally and transversely is accomplished. Typical and preferred transverse expansions range from about 15 to 25%, although tensioning does not necessarily result in expansion.

The means for expansion can be a tenter frame, or the like, as desired. Preferred tenter frames are those of the type which operate continuously so that a given starting fabric can be continuously tensioned and moved past one or more of a plurality of processing stations. Continuous tenter frames are known to the art and do not as such constitute a part of the present invention.

In general, a starting fabric employed in the practice of the present invention has a back comprised of yarn having a denier ranging from about 150 to 600. The pile of the starting fabric is comprised of fibers extending from about ⅛ to 2 inches in height over the backing. The pile is comprised, on a 100 weight percent total pile basis, of from about 10 to 90 weight percent of heat shrinkable fibers with the balance up to 100 weight percent thereof being thermally stable fibers. Characteristically, the heat shrinkable fibers are heat shrinkable at a heat shrinking temperature which typically ranges from about 200° to 350° F. and characteristically and preferably the heat shrinkage is obtained at heat shrinking temperatures within determinable heat shrinking times. Typically, at the heat shrinking temperatures indicated, the heat shrinking times range from about 1 to 5 minutes.

In a starting fabric, the weight ratio of pile fiber to backing yarn ranges from about 2.5:1 to 16:1. Also, in a starting fabric, there are characteristically from about 10 to 24 wales per inch and from about 17 to 42 courses per inch.

In a preferred class of starting fabric materials usable in the practice of the present invention, one selects and employs a sliver knit, high pile, differentially transversely knitted, longitudinally patterned, unstabilized starting fabric having a pile containing heat shrinkable fibers. Such a fabric and methods for its manufacture are described in copending U.S. patent application Ser. No. 911,422 filed on even date herewith in the names of Guy N. Kieckhefer and Brady T. Grubbs as co-inventors and assigned to a common assignee. Each pattern in such a pile of such a preferred starting fabric is preferably chosen to resemble an animals fur with individual animals being in a longitudinally aligned relationship to one another in the starting knitted pile fabric.

Such a preferred starting fabric has a backing comprised of longitudinally dimensionally stable and thermally stable yarn. Such backing preferably contains from about 8 to 24 wales per inch. Typical and preferred backing yarns have deniers in the range from about 150 to 600. Examples of suitable backing yarns include spun polyester, slit film olefins, filament olefins, and the like. Physical and chemical characteristics of backing yarns usable in the practice of this invention can vary widely, the values being used in any given case being dependent upon variables such as availability, cost and the like, typically. Commonly, backing yarns have an elongation at break of at least about 10%, a yarn tenacity of at least about 4 grams per denier, and a specific gravity of at least about 0.9. Commonly also such a backing yarn has from about 1 to 2 turns per inch. Of course, yarns having other physical characteristics can be used in the practice of this invention without departing from the spirit and scope thereof, as those skilled in the art will appreciate.

The pile of such a preferred starting fabric is generally characterized by having a height above the backing ranging from about ¼ to 2 inches. The weight ratio of pile to backing ranges from about 2.5:1 to 16:1. Preferably such weight ratio ranges from about 3:1 to 10:1. Preferably, such contains 10 to 50 weight % heat shrinkable fibers.

Broadly, the pile of such preferred starting fabric is comprised of from about 10 to 90 weight percent of heat shrinkable fibers with the balance up to 100 weight percent thereof being non-heat shrinkable fibers. The heat shrinkable fibers preferably have a heat shrinkability such that at temperatures in the range of from about 250° to 310° F. shrinkage longitudinally of from about 10 to 60 percent occurs within a preferred heat shrinkage time ranging from about 2 to 4 minutes. Commonly heat shrinkable fibers in such preferred starting fabric have deniers ranging from about 1.5 to 50 although denier is a relatively unimportant factor for purposes of the present invention as those skilled in the art will appreciate. Natural animal fur appears to vary over an extremely wide range as respects denier. It is known, for example, that one species of mink is characterized by hair having denier variations of approximately from perhaps 1 to 90 denier in a single animal pelt.

Thermally stable fibers employed in the pile of such a preferred starting fabric typically and preferably have lengths initially in the range of from about ¼ to 2 inches and deniers in the range of from about 3 to 50, though, as indicated above, the denier of the pile fibers is a relatively unimportant consideration in the practice of the present invention. Examples of suitable thermally stable fibers include acrylics, modified acrylics, polyesters, polyamides, and the like.

In such a preferred starting fabric, two or more different kinds of heat shrinkable fibers, and two or more different kinds of thermally stable fibers may be employed. In such preferred fabric, matters such as local fiber color, fabric pattern, pile variations (longitudinally or transversely) within an individual pile pattern from pattern repeat to pattern repeat, of course, as those skilled in the art will appreciate, can vary widely depending upon the particular type of effect desired. For example, perhaps a desired preferred pattern has no resemblance to any known or naturally occurring animal fur.

For example, one type of a more preferred such starting fabric uses a pile comprised of at least two different classes of heat shrinkable fibers. Thus, the composition of one such type of heat shrinkable fiber has a heat shrinkability typically in the range of from about 10 to 20% with deniers in the range of from about 1.5 to 6. A second class of heat shrinkable fibers has a heat shrinkability in the range of from about 18 to 35% and has a denier in the range of from about 3 to 12. The relative ratio of such first class to such second class of heat shrinkable fibers (in terms of weight percent based on 100 weight percent total such heat shrinkable fibers) can range from about 4:6 to 6:4 in any given fabric. The respective colors of such fiber classes can be mixed, or not, as desired for a particular pattern effect. A single class of thermally stable fibers can, of course, be used with such mixture of heat shrinkable fibers, or otherwise, if desired.

In one preferred type of pile fiber composition for use in a preferred starting fabric employed in the practice of the present invention, three different types of fibers are employed. The characteristics of the respective components in such a pile blend are shown in Table 1 below:

TABLE I

| FIBER COMPONENT | FIBER HEAT SHRINK ABILITY | RELATIVE DIAMETER | RELATIVE* POPULATION |
|---|---|---|---|
| A | High shrink (20–25% shrink) | 2.5D | N × 6 |
| B | Moderate shrink (10–15% shrink) | 1.8D | N × 2 |
| C | Stabilized no shrink (3% shrink) | D | N |

*N designates the total weight of all pile fibers.

The starting fabrics useful in the practice of this invention are preferably prepared upon circular knitting machines wherein one circularly knits a deep pile fabric structure having characteristics as above described. The resulting tubular structure has circumferentially incrementally variable differences and a longitudinally extending pattern. A given pattern can have both circumferential and longitudinal variations therein so as to simulate a given animal fur or pelt arrangement, as desired. After the fabric has been knitted, it is longitudinally slit. Within a given deep pile fabric structure, differences in pile fabric composition can occur circumferentially (transversely in the slit fabric) from one location to another. For example, the edges of a given pelt simulation are typically whitish or light colored in comparison to the dark or central Gratzen region although any particular color combination with respect to color gradations between Gratzen and edge pelt portions can be achieved, as desired. The transverse width of a pattern repeat in a starting fabric can vary widely. In the case of one type of preferred starting materials, the pattern repeat is in the range typically of from about 10 to 200 (preferably from about 25 to 40) wales; though larger and smaller numbers of wales may be included within an individual pattern, as desired, as those skilled in the art will appreciate.

One preferred class of starting fabrics useful in the present invention employs a pile comprised of from about 45 to 70 percent, on a total pile weight basis, of acrylic fibers. Of these fibers, about 20 to 40 weight percent thereof are of the heat shrinkable acrylic type having a denier of from about 2 to 5 (the percentage of such fiber being expressed on a 100 weight percent total pile fiber weight basis). Similarly, on the same weight basis, of such total weight percentage of acrylics, about 5 to 15 weight percent thereof is comprised of acrylic fibers having a denier of about 8 and such fibers are substantially not heat shrinkable.

In addition to the acrylic fibers present, such pile may contain from about 10 to 50 weight percent, on a total pile fiber composition weight basis of modified acrylic fibers having a denier of from about 12 to 40, such modified acrylic fibers being substantially not heat shrinkable. Furthermore, such a pile fiber composition also contains from about 10 to 50 weight percent of modified acrylic fibers which are not heat shrinkable (on a total pile composition weight basis) but have deniers in the range of from about 12 to 40. Bright or dull fibers may be employed. In such composition, the initial length of the fibers ranges typically from about ½ to 3 inches in preferred starting fibers.

While characteristically natural fibers can be employed in the pile of fabric used in the practice of this invention, it is preferred now that synthetic fibers be employed because of the controllability in the selection of the characteristics of such fibers that is possible through the use of synthetic fibers in the pile from the standpoint of knitting machines.

After being prepared, and before use in the practice of the present invention, a starting fabric may be interveningly stored.

Typically, and by way of example, a starting fabric used in the practice of the present invention may have, in its initial relaxed state, a width ranging from about 48 to 72 inches, although widths larger and smaller can be employed. The width of individual pattern repeats transversely across such a starting fabric preferably ranges from about 2 to 4.5 inches, but the transverse width of a pattern repeat can vary widely. Preferably, a given starting fabric has at least 3 pattern repeats, and may possibly have as many as 50 or more pattern repeats, depending upon the width thereof, as those skilled in the art will appreciate. It is not, however, necessary for a starting fabric to have a pattern repeat since the advantages and practice of the present invention are applicable to starting fabrics which do not contain any longitudinally extending patterns having a transverse pattern repeat characteristic, although starting fabrics having a pattern repeat transversely are preferred.

To the surface of the back of a starting fabric so tensioned one uniformly applies a first coating composition. Such first coating composition is comprised of an organic polymeric material which has a glass transition temperature not above about 0° C. (and preferably not above about −15° C.) Such organic polymeric material is capable of bonding to the back of the fabric after application thereto when such combination of backing and organic polymeric material are heated together to a first temperature which is below the heat shrinking temperature of the heat shrinkable fibers within a time interval which is within the range of from about 1 to 5 minutes, typically.

After undergoing such a heating, the polymeric material and the first coating composition functions to dimensionally stabilize a fabric so treated to an extent sufficient to prevent such fabric from recovering from its so tensioned configuration downwards (as respects transverse width and longitudinal length beyond a predetermined value, particularly as respects a predetermined transverse width when the tensioning is subsequently removed. The reason for such predetermined transverse width will become apparent herein below.

After application of the first coating composition to the back of the tensioned fabric, one heats the resulting coated fabric backing to such a first temperature for such a time sufficient to achieve the desired bonding between polymeric material and fabric backing with the fabric being so tensioned. Typical first heating temperatures range from about 250° to 300° C., and thus are below the temperature at which any appreciable amount of heat shrinkage of heat shrinkable fibers occurs. After the heating, the fabric is de-tensioned, that is, the initial tensioning is removed, preferably after the fabric is cooled.

The resulting fabric is now subjected to a contour shearing operation. In such a contour shearing operation, a series of steps are simultaneously performed upon such resulting fabric. Thus, one step involves passing the resulting fabric longitudinally through a contour shearing zone extending transversely across the resulting fabric. The transverse width of the contour shearing zone is equal to the above indicated predetermined transverse width.

Concurrently with such passing, one longitudinally tensions transversely the resulting fabric. The amount of longitudinal tensioning applied to the fabric is sufficient to draw down the transverse width thereof, if necessary, to an extent sufficient to cause the resulting width of the fabric to be substantially equal to such predetermined width (or, in effect, equal to the transverse width of such contour shearing zone). The effect of such passing and such longitudinal tensioning is such as to achieve a predetermined registration between contours in the contour shearing zone and the pile fabric; for example, a desired registration between contours in the contour shearing zone and respective individual pattern repeats in the resulting fabric being subjected to contour shearing.

Concurrently with such a passing and such a longitudinal tensioning, contour shearing of the pile of the resulting fabric is carried out.

As indicated above, contour shearing is preferably carried out in accordance with the practices of the present invention using a contour shear device of the type described and shown in the above referenced Abler U.S. Pat. No. 4,102,023.

The resulting so contour sheared fabric is, if desired, interveningly stored before being subjected to a processing operation. In general, such subsequent processing involves a second heating operation in which simultaneously another series of steps is carried out. Thus, in such second heating operation, one heats the so-contour sheared fabric to the heat shrinking temperatures of the heat shrinkable fibers for their heat shrinking times, which are as indicated above.

Concurrently, one tensions transversely and longitudinally the so contour sheared fabric to an extent sufficient to expand the respective lengths and breadths thereof to values approximately and preferably corresponding to those used in the initial tensioning (relative to the initial relaxed state of the starting fabric). In general, the preferences and conditions of tensioning can be as described above for the first or initial tensioning. For purposes of tensioning, one can employ here a tenter frame, preferably a continuously movable tenter frame, as before.

Concurrently with such second heating and second tensioning, one maintains the contour sheared pile of the contour sheared fabric in a free state. By the term "free state", reference is had to the fact that the exposed surface of the pile is not permitted to contact any solid object while being so secondly heated and so secondly tensioned in order to avoid any possibility of giving to the fabric pile fiber a set, crease, or the like, which would be undesired.

By the above indicated sequence of processing steps, for the first time, it is possible to achieve a product knitted pile fabric which has been contour sheared and wherein the individual fibers of the pile thereof do not have a flattened, uniform surface transversely across the width of the product fabric. In addition to important decorative effects for use in the manufacture of striped fabrics for upholstery, clothing and the like (whether or not such are patterned or have different colors transversely across the width thereof), the present invention is particularly well suited for the manufacture of knitted pile fabrics wherein the pile thereof has an appearance which resembles a seemingly seamed together group of longitudinally aligned animal pelts, each of the pelts having a Gratzen extending longitudinally therethrough. The Gratzen can be of any desired configuration or type. One preferred type of Gratzen is generally darker in color and thicker in texture than adjoining areas thereof. Each of the pelts in such knitted pile fabric has simulated guard hairs and simulated base hairs.

In the practice of this invention, it will be appreciated that individual pieces of a starting fabric can be spliced or otherwise bound together longitudinally so that a continuous mode of practicing the present invention can be carried out with an endless loop of starting fabric. In carrying out the back coating operation above described, any convenient coating procedure and coating apparatus may be employed, though preferably continuous coating techniques are utilized. Knife coating involving a doctor blade, and roller coating involving a roller are presently preferred, coating techniques.

In one convenient present mode, the back face of the starting fabric is turned upwards and a knife coater is extended transversely across the longitudinally continuously moving starting fabric which is tensioned as above described. A reservoir of a liquid or foamed coating composition is continuously deposited upon the moving fabric behind or in front of a knife blade whose surface engages at some convenient vertical pressure the surface of the fabric moving therebeneath. Conveniently, the knife blade trails behind the reservoir of coating composition relative to the direction of fabric movement and the knife blade tensioning is such as to provide for a technique of controlling the amount of coating composition deposited upon the fabric back being coated. The reservoir or well which leads the coating blade is continuously supplied with coating composition with the fabric web being mounted on a tenter frame with the backing side up and the pile side down. A coating is thus applied directly upon the web from the bottom of the well immediately ahead of the blade wiping the web. The wiping action forces the coating composition into the web and also enables one to meter the amount of coating composition applied to and into the web. The well aids in leveling the coating composition so that a uniform application and distribution of coating composition transversely across a fabric web is achieved during a coating operation. The particular fabric web being coated is backed up or supported underneath on its bottom or pile side by some means, such as a blade member 25a (see FIG. 7) which is stationary, or a roller member 76a (see FIG. 10.) which revolves, with the circumference of the roller thereof moving in the direction of pile fabric web translation. Thus, the wiper blade on the top against the back surface of the fabric has a base against which to exert a pressure. Preferably, some degree of force is exerted by the wiper blade upon the pile fiber, but the degree of force exerted is generally less than that which will cause an actual movement of the pile or the fabric through direct application of the blade thereto. Such a coating apparatus is known to the prior art and does not as such constitute a point of novelty in the practice of the present invention.

Coating compositions useful in the practice of the present invention are characterized by having the capacity, as indicated above, when dried, to stiffen and dimensionally stabilize the backing of a pile fabric used in the practice of the present invention. Preferred coating compositions are in the form of a liquid. Conveniently, the liquid can be employed as such or in a foamed condition. After the coating composition is applied, as described above, the so-coated back surface of the fabric is exposed to temperatures which are sufficient to remove the volatile components of the coating composition, such as water or other solvent used as a fluid carrier for the coating composition. Also, in the case of some polymeric materials, this heating affords the polymer a chance to develop a bond between portions of the fabric and the polymer thereby to improve the dimensional stability characteristics of the resulting so-coated and heat treated fabric system.

Preferably, the resulting so coated and heated fabric, relative to a starting fabric, is stiffened and stabilized dimensionally to such an extent that the fabric no longer tends to contract appreciably in transverse and longitudinal directions when tensioning forces are removed therefrom following coating and heating.

If desired, the coating composition employed can be one of the type which contains a curing agent. During the initial heating, the curing agent optionally may or may not chemically operate to cross link the coating composition. At the present time it is believed that a cross linking should preferably occur during the second heating operation after the fabric has been contour sheared as described above.

Many different coating compositions known to the prior art appear to be suitable for use in the practice of the present invention. At the present time, preferred coating compositions are in the form of aqueous solutions, emulsions, dispersions, or the like containing therein a desired polymeric material. The polymeric material can be in the form of homopolymer or copolymer. Preferably the starting polymer has not yet been cross linked if it is cross linkable. Blends of different polymers can be employed which may or may not be reactable with one another under the conditions of practicing the technology of the present invention. One class of suitable polymers comprises synthetic and natural rubbers (elastomers) which may be blended together in a starting coating composition. Examples of suitable polymers include polychloroprene (neoprene), styrene butadiene latices, carboxylated styrene butadiene copolymers containing at least 50 weight percent or more of bound styrene, emulsion copolymers containing lower alkyl acrylates and acrylonitrile, and the like.

One class of presently preferred coating compositions incorporate polymers and associated components which are adapted to, when dried, cross link at temperatures in the range of from about 250° to 350° C., or at temperatures which are in the range of heat shrinking temperatures associated with heat shrinkable fibers employed in starting fabrics of the present invention. Moreover, such preferred polymeric systems are adapted to achieve a substantially complete cross linking within the heat shrinking times utilized for achieving heat shrinking in heat shrinkable fibers at heat shrinking temperatures.

In one preferred mode of practicing the present invention, a resulting coated and heated pile fabric is not only dimensionally stabilized without achieving substantially any heat shrinkage of heat shrinkable fibers, but also is adapted to be transversely and/or longitudinally elongated over and above the dimensions associated with the coated and heated pile fabric. After being so tensioned transversely and/or longitudinally, and then such tensioning is released, the coated, heated fabric is capable, preferably, of recovering its originally coated, heated dimensions within about 10%. The use of coating compositions which result in a rigidification of a resulting coated and heated fabric used in this invention to such an extent that transverse and/or longitudinal tensioning thereof cannot be accomplished without some recovery should be avoided, preferably, for purposes of practicing the present invention.

Typical coating compositions employed in the practice of this invention contain, at the time of coating in accordance with the present invention, from about 5 to 65 weight percent solids, with the balance up to 100 weight percent thereof being volatile liquid, preferably water. The solids contained in such a coating composition can preferably comprise mainly polymer, although the coating composition can also employ from about 2 to 20 weight percent of various other agents, such as thickeners, colorants, flame retardants, fillers, cross linking agents, polymerizable monomers, and the like, as desired.

Typical coating rates for the first coating composition can vary widely. Common rates fall in the range of from about 0.05 to 2 pounds of coating composition solids per lineal yard of coated fabric on a 100 percent dry weight basis. The amount of coating composition applied in any given instance is generally at least sufficient to achieve a desired dimensional stabilizing action, as above described. More preferred coating rates for purposes of the present invention range from about 0.01 to 0.5 pounds of coating solids per linear yard of coated fabric (same basis).

First heating temperatures to which a coated fabric is subjected, in accordance with the practice of the present invention, likewise can vary widely, but presently tend broadly to range from about 215° to 260° F. Temperatures below this range tend to be too low, and therefore, too slow, while temperatures above this range tend to induce the possibility of undesirable shrinkage of heat shrinkable fibers. Preferred temperatures range from about 225° to 255° F. Preferred temperature exposure times in the range of from about 1 to 5 minutes can be employed and preferably are in the range of from about 2 to 4 minutes.

As those skilled in the art will appreciate, in addition to bilaterally stabilizing dimensionally a fabric being used in the practice of the present invention, the coating and heating steps with the starting fabric, as hereinabove described, accomplish the desirable effect of binding the individual fibers in the pile to the associated backing yarns locally so that the individual tufts of pile fibers are not easily dislodged from the product fabric. Typically, coating application rates as above indicated, along with other coating conditions and heating conditions, are sufficient and adequate in order to obtain a desirable bonding of pile fibers to yarn fibers to an extent sufficient to achieve useful products by the practice of the teachings of the present invention.

After being contour sheared, a resulting pile fabric can be stored, if desired, before being subjected to further processing, storing conveniently being accomplished by coiling, plating, or the like, as desired.

In accordance with one preferred practice of the present invention, before being subjected to a second heating operation and after being contour sheared, a contour sheared fabric is subjected to a second coating operation. Such a second coating operation is conveniently and preferably performed in a manner similar to that employed for the first coating operation above described, though any convenient coating procedure can be employed if desired. Such fabric is tensioned as above described during such a second coating operation.

Coating conditions, application rates, compositions, etc., are similar to those employed for the first coating operation, if desired. When utilizing the second coating procedure, one can employ in the first coating operation less coating solids than if a single pass coating operation is desired, preferably. When employing two coatings, the first coating is applied at a rate conveniently in the range of from about 0.01 to 0.50 pounds per lineal yard and the second coating is applied at a rate of from about 0.01 to 0.50 pounds per lineal yard. As used herein, it is noted that the term "pounds per lineal yard" has reference to a fabric having a transverse width of approximately 60 inches, or equivalent. Either the same or different coating composition can be employed during the second coating operation as is employed in the first coating operation. In one preferred mode of operating, the coating composition employed in each of the first and the second coating operations is identical.

During the second coating operation, the fabric being coated is tensioned in a manner similar to that employed initially. After the second coating operation is completed, and while the thus twice coated fabric is still tensioned, it is preferably immediately subjected, as in the case of the first coating and first heating, to a second heating operation, with the heating conditions in the second heating operation being similar to those described above.

As indicated above, the second heating is conducted at temperatures sufficient to both accomplish heat shrinking of heat shrinkable fibers and also to accomplish a substantially complete drying of the coating composition employed in the second coating operation. If the coating composition employed is one which cures, the temperatures of curing of such coating composition are preferably selected so that the second heating may be carried out at temperatures which are sufficient both to heat shrink the heat shrinkable fibers and also to accomplish a substantially complete curing of the coating composition.

Whether or not a second coating operation is employed, the product fabric emerging from the second heating step is substantially completely dimensionally stabilized, by which reference is had to the fact that the product fabric displays a tendency not to shrink or diminish in size by a factor of more than about 10% transversely or longitudinally after the tensioning of the fabric is removed following completion of the second heating step. Preferably, the fabric displays, after such second heating step, substantially no tendency to dimensionally change upon removal of tensioning forces therefrom.

The two coating procedure is preferred for purposes of the present invention since such procedure imparts to a product fabric desirable dimensional stability characteristics. The dimensional stability of a thus twice coated and heated product of the present invention tends to be better than that achieved with a single coating operation in accordance with the practice of the present invention.

As used herein, the term "Gratzen" has reference to a stripe running down the back center region of a fur pelt (whether synthetic or not). The stripe has a different and generally thicker texture and fur length than adjoining areas. The term "Gratzen" includes the connotation of shadings as is typical of the shadings which occur in the back of animals having Gratzens, in general. The Gratzen can be regarded as a central region longitudinally extending through the pelt of an animal characteristically having a Gratzen.

A simulated fabric product made by the teachings of this invention thus is made on a circular knitting machine and is comprised of seemingly seamed together animal pelts wherein the individual pelts are longitudinally arranged relative to one another in rows, have individually discernable, predetermined Gratzens, and have nonuniform textures (including fur fiber variations). Each individual simulated animal pelt row is characterized by changing features as one proceeds transversely across such an individual pelt row. Thus, there is a change not only in the pile structure, but also in the distances between wales, in a preferred embodiment of the present invention. The structure of such a preferred product is such that the transverse width of the individual simulated pelts transversely across a product fabric is substantially equal to the transverse width of the others thereof. For this purpose, one uses, as a starting material, a differentially knit, sliver knit, high pile fabric prepared as described in the above referenced co-pending application filed on even date herewith, the contents of which are entirely incorporated herein by reference.

Fabrics produced by the practice of the present invention preferably are patterned, and experience of systematic variation of fiber blend within an individual pattern repeat as one progresses transversely across a fabric product of this invention and examines transversely the pile thereof. Texture effects and color shadings are desirable because animal pelts characteristically are not uniform, and there is experienced preferably variations as one proceeds from one square inch to another across a synthetic fur piece comprised of seemingly seemed together animal pelts.

In preferred products of this invention of this type, the Gratzen width of each individual simulated pelt row occupies perhaps a total of about 50% of the total pelt width, and is perhaps inset up to about one-third of the side distance inwards from a lateral side edge of each pelt row in the mid regions of an individual pelt row. The effect of longer guard hairs is achieved by using heavier denier fibers in the Gratzen area of an individual pelt row. The guard hairs which occur in the belly regions of a simulated pelt can have a different denier from those in the Gratzen region. The length of the base hairs and guard hairs relative to one another can vary greatly. For purposes of the present invention, the ratio of the length of guard hairs to body hairs or base hairs in a given simulated pelt can range from about 2:1 to 1.1:1, although longer and shorter such ratios can be achieved without departing from the spirit and scope of the present invention. The number of guard hairs relative to base hairs also can vary from one simulated pelt to another. Conveniently, for purposes of the present invention, this ratio on the basis of weight can extend from about 1:1 to 0.3:1, although larger and smaller such ratios can be achieved without departing from the spirit and scope of the present invention.

In the most presently preferred practice of the present invention, a first and a second coating operation are each employed as above described. In the first coating, a relatively small amount of coating composition (in the range of from about 0.01 to 0.2 pounds per linear yard of coating solids) is applied for the reason that it is desired to be able to control the width of the fabric under tension at the region of contour shearing in a contour shearing operation. It has been found that it can be difficult to control the transverse width of a fabric during contour shearing, so that it is advisable to be able to permit an operator to have the ready capacity to variably alter the tension of a fabric being contour sheared as the contour shearing operation progresses so as to be able to continuously maintain the predetermined desired alignment between contour shearing apparatus and fabric being contour sheared thereby to achieve a desirable and precise contour shearing. If a relatively heavy first coating is applied, it has been found that it is generally more difficult to precisely control tension in the longitudinal direction in the contour shearing zone. It also appears that, in tensioning after the first coating and heating operations, particularly longitudinally, one tends to rupture, or break, or loosen, some, or all, of the adhesive bonds existing from wale to wale as a result of the contour shearing operation. The adhesive bonding achieved with a relatively light first coating has proven to be sufficient for purposes of achieving a desirable and controllable dimensional stability for use in contour shearing as above described.

After a given contour shearing operation has been completed, these loosened areas of bond between overlying members of fabric can be re-stabilized dimensionally by passing the resulting pile fabric through the second heating zone. However, to augment the effect of the first coating, the second coating operation is preferred before the second heating is experienced, thereby to enhance the bonding action between the adjoining members of the fabric, and also to bridge the bonds that were loosened or broken when the width of the fabric was reduced following the first coating operation and subsequent heating during the contour shearing step as above described.

The product resulting from the second heating operation as above described can either be used as such, or it can be subjected to further processing operations, if desired. For example, one can subject the product fabric resulting from a second heating operation to a sequence of steps involving passage of the fabric through an electrifier followed by subsequent passage through a shearing apparatus (to eliminate stray hairs projecting upwardly developed in the fabric as a result of the electrifier operation). Such a sequence of electrification followed by shearing can be practiced more than once. As those skilled in the art will appreciate, an electrifier functions to polish and to straighten the terminal outer end regions of individual fibers comprising a pile in a knitted fabric. Conventional electrifier technology and post-electrifier shear technology can be employed with care, of course, being taken not to disrupt the desired effects achieved in the contour sheared, heat shrunken heat shrinkable fibers incorporated into the pile of a product fabric of this invention. As those skilled in the art will appreciate, a variety of subsequent processing steps, if desired, can be employed so as to process a given product of this invention into a final fabric product having special properties, as an individual use situation may demand. The electrifier operation is sometimes called by those skilled in the art "fur ironing" since one straightens out certain of the fibers in a pile and removes the crimp therefrom, so that, thereafter, when the structure of the fiber is passed through the electrifier, different fibers are affected thereby to different degrees. The shearing intervening between subsequent pairs of electrifier operation or processing operates to remove the fibers of extreme length, sometimes called by those skilled in the art the wile.

Figure 5:
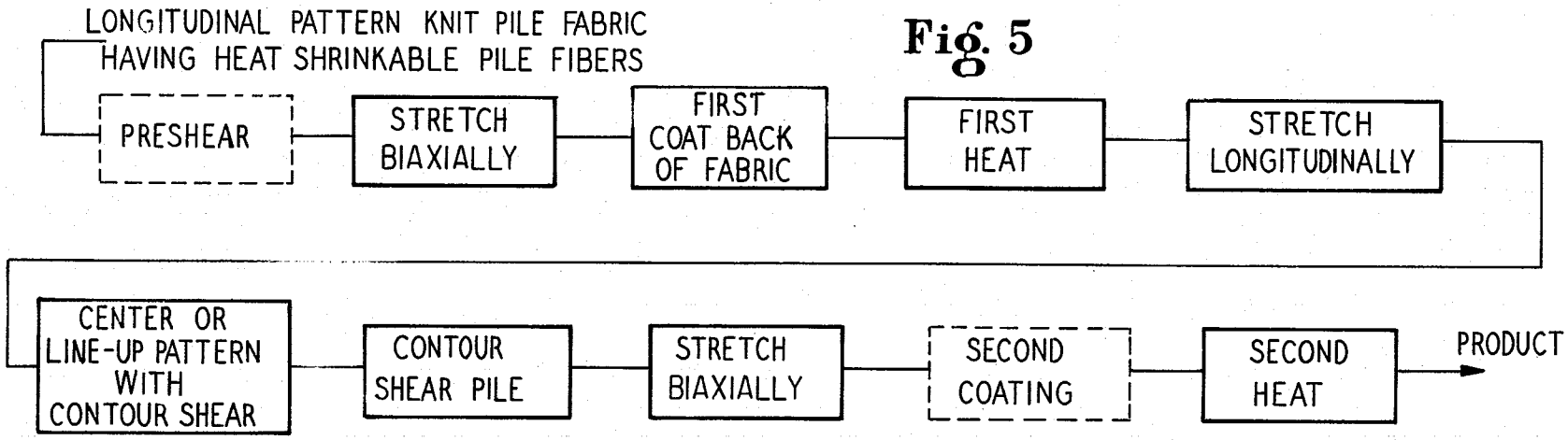
FIG. 5 is a flow diagram of one mode of practicing the process of the present invention.

Referring to the drawings, there is seen in FIG. 5 the type of manufacturing sequence employable in the practice of the present invention. Here, the starting knit pile fabric has a longitudinal pattern and the pile incorporates fibers having heat shrinkable characteristics. This fabric is previously not dimensionally stabilized. Preferably, before being used in the practice of the process of the present invention, such pile fabric is subjected to a pre-shearing operation (not contour shearing but a uniform transverse shear) which is accomplished by passing the fabric through a conventional shearing apparatus of the type heretofore used in the art of high pile, sliver knit fabrics. The purpose of the pre-shearing operation is to improve the product quality of the final product by eliminating initially pile fiber surface irregularities which are characteristically common to products produced by circular knitting machines and the like.

The pre-sheared knit pile fabric is then bilaterally stretched, and, while so stretched, is subjected to a first coating operation, followed by a first heating operation, after which the bilateral stretching is ceased. Then, the resulting knit pile fabric is stretched longitudinally, and is subjected to contour shearing, with any longitudinal pattern in the knit pile fabric being centered and registered with the contour shearing apparatus. Thereafter, the resulting contour sheared pile fabric is bilaterally stretched, similarly to the manner in which bilateral stretching is earlier accomplished, and then the contour sheared pile fabric is subjected here to a second coating operation followed by a second heating operation while so stretched bilaterally. The product which results can then be used as such, or subjected to further processing, as as herein described.

Figure 6:
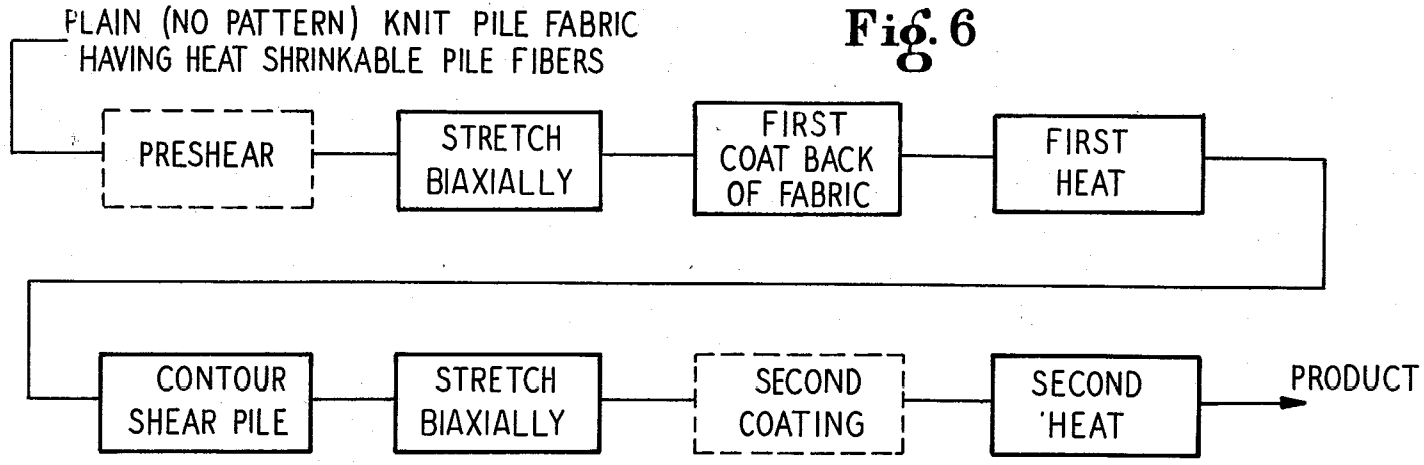
FIG. 6 is a view similar to FIG. 5 but showing another flow diagram.

Referring to FIG. 6, there is seen an alternative mode for practicing the present invention. Here, plain goods comprising knit pile fabric without a pattern therein, but containing about 10–60% heat shrinkable pile fibers is subjected to a preferred but optional pre-shearing operation similar to that above described in reference to FIG. 5.

Thereafter, the resulting fabric is stretched bilaterally, and while so stretched, is subjected to coating and heating operations. After the stretching bilaterally is removed, the fabric is contour sheared. During contour shearing, the fabric is stretched longitudinally to a desired extent so as to achieve a desired or predetermined registration and alignment of the plain knit pile fabric goods with the contours in the contour pile shear apparatus.

Next, the resulting contour sheared pile fabric is stretched bilaterally in a manner similar to that earlier accomplished, and is optionally but preferably subjected to a second coating operation. Following such optional second coating operation, the second heating is undertaken, and bilateral stretching is thereafter ceased, as above, to produce a product having the features and characteristics herein detailed.

Figure 7:
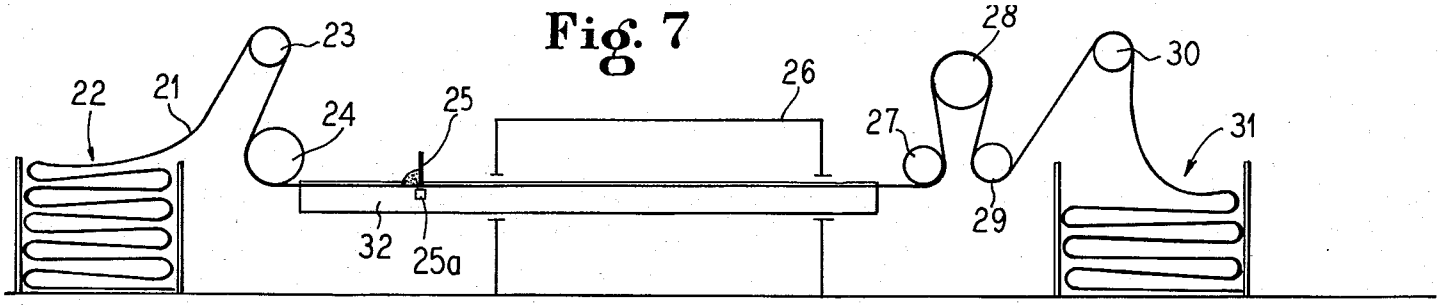
FIGS. 7, 8 and 9 diagrammatically illustrate sequential manufacturing steps employed in a preferred mode of practicing the process of the present invention.

One manner in which the sequence of bilateral stretching, first coating, and first heating can be accomplished is illustrated in FIG. 7. Here, a fabric 21 supplied from a pleat 22 is passed over rollers 23 and 24. From roller 24 the fabric 21 is fed onto a continuously operating tenter frame assembly 32 which transversely and longitudinally stretches the fabric 21 to a predetermined extent as above described. Thus, while passing through the coating apparatus 25 and the oven 26, the fabric 21 is maintained under longitudinal and transverse tension by the continuously operating tenter frame 32. In these drawings longer diameter rollers generally indicate drive rollers. From roller 24 the fabric 21 is passed under a knife coating apparatus 25, such as hereinabove described. The fabric 21 is arranged and oriented pile-side down so that the back of the fabric receives the coating from the coating apparatus 25 so that a uniform rate of coating composition is applied to the back of the fabric 21. From the coater 25, the fabric is continuously transported through an oven 26. The forward speed of the fabric 21, and the temperature of the oven 26, are arranged so that the time and temperature exposure of the fabric 21 in the oven 26 correspond to the first heating times and temperatures hereinabove described. After leaving the oven 26 wherein the pile of the fabric 21 is held in a substantially free condition so as not to adversely affect same, the resulting so-coated pile is fed over rollers 27, 28, and 29 before being passed over a roller 30 and formed into a pleat 31 for storage. As can be seen from FIG. 7, as the fabric 21 leaves the oven 26, the tension thereon is released.

Figure 8:
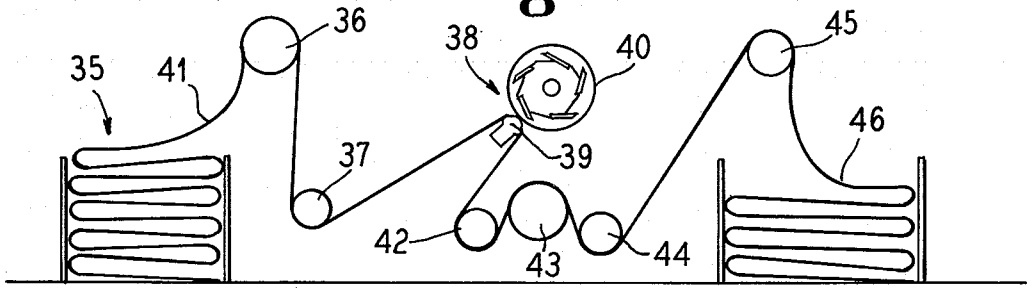

The sequence of passage, longitudinal stretching, registration, centering, and contour shearing is illustrated in FIG. 8. Here, a pleat 35 of fabric which has been previously tensioned, coated and heated as above described is fed over roller 36 and 37 into and through the nip region 38 defined between a contour shear bar 39 of the type shown in the above referenced Abler U.S. Pat. No. 4,102,023 and a contour shear roller 40, with longitudinal tension of the fabric 41 being maintained over the bar 39 by means of rollers 36 and 43, such tension being adjustable and correctable so as to maintain a desired width for the fabric 41 as it passes over the contour shear bar 39 in a desired centered and registered relationship between the contour shear bar 39 and the shear roller 40 in the nip region 38. From roller 42, the fabric 41, now contour sheared, passes over the rollers 43, 44 and 45 before being formed into a pleat 46 for intervening storage.

Figure 9:
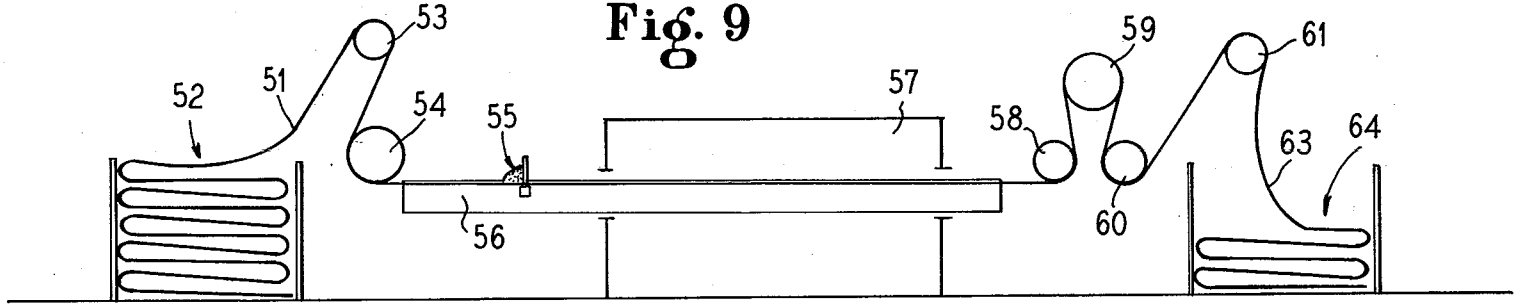

The sequence of bilateral stretching followed by second heating is illustrated in FIG. 9. Here, previously contour sheared fabric 51 is supplied from a storage pleat 52 over rollers 53 and 54 to a knife coating station 55 which can be constructed as above described, and which can be similar to the knife coating apparatus 25, above described in FIG. 7.

As will be seen from FIG. 9, the fabric 51 is fed from roller 54 directly to a continuously operating tenter frame 56 so that as the fabric 51 passes under the coating apparatus 55 such is maintained under transverse and longitudinal tension whose respective magnitudes correspond to that earlier employed on the tenter frame 32 above described.

The second coating station 55 represents an optional but preferred embodiment of the present invention, as described above. While still tensioned, the fabric 51 after being coated passes into and through an oven 57. The temperature inside oven 57 along with the residence time of the fabric 51 therein is such that the heat shrinkable fibers in Fabric 51 are heat shrunk to a desirable extent during the passage of the fabric 51 through the oven 57. Concurrently, the temperature in the oven 57 along with the residence time of the fabric 51 therein is such that the coating composition applied at coating station 55 and also the coating composition earlier applied at the coating station 25 undergo a substantially complete drying and curing operation so as to develop in the product fabric emerging from the oven 57 a desired degree of dimensional stability. As the fabric emerges from the oven 57 it is permitted to be de-tensioned as it passes over the succession of rollers 58, 59, 60 and 61 after which the fabric 51 is permitted to be placed into a storage pleat 64 or the like, as desired.

As those skilled in the art will appreciate, between rolls 30 and 36, a fabric being processed in accordance with the present invention is inverted and, similarly, between rollers 45 and 53 such a fabric is again inverted. During passage of the fabric 51 through oven 57, the pile of the fabric 51 is maintained in a free condition to avoid any change in the characteristics thereof while exposed to the oven heat 57 beyond the desired longitudinal shrinkage of the heat shrinkable fibers therein.

Figures 10, 11, 12, 13, 14:
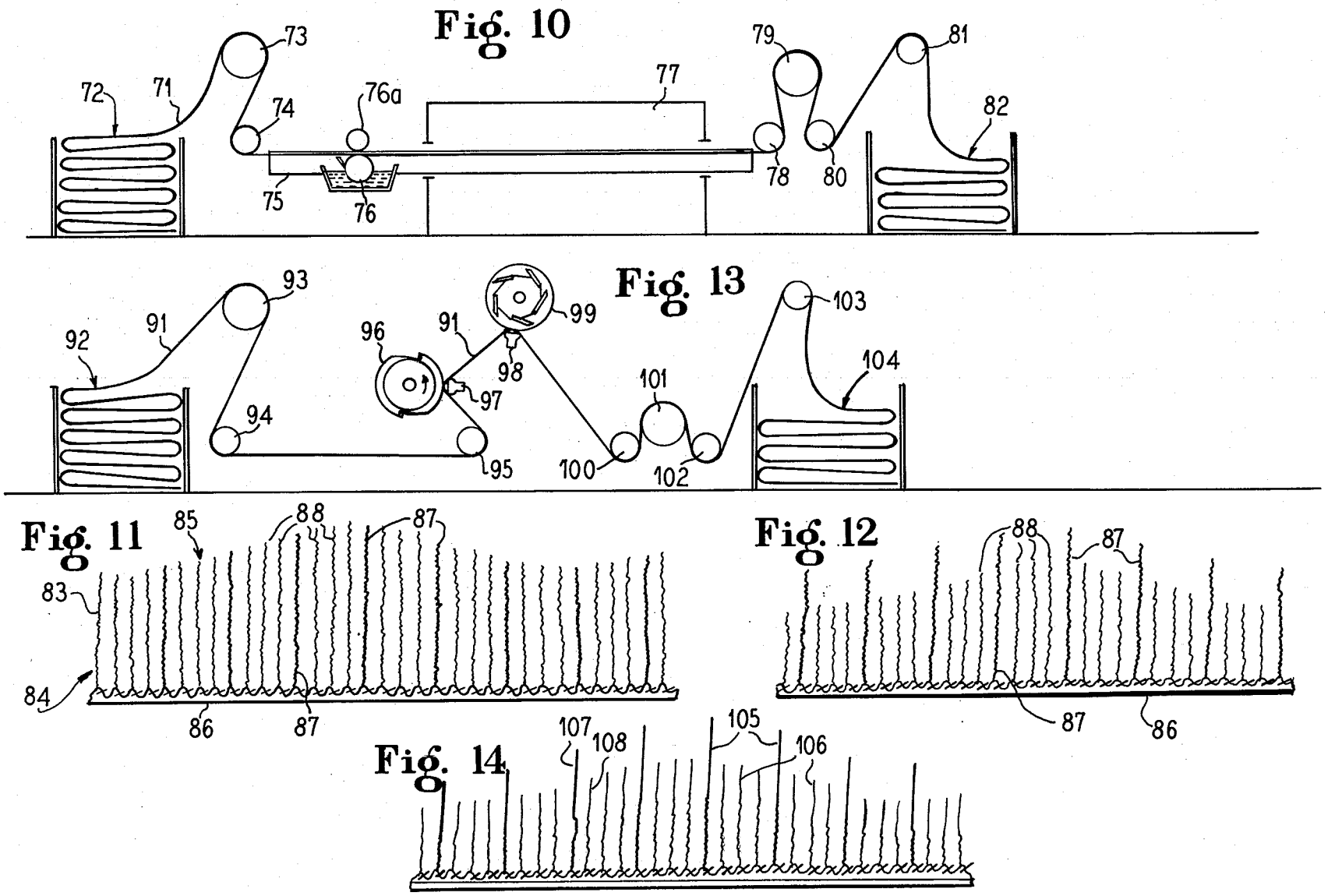
FIG. 10 is a view similar to FIG. 7 but showing an alternative technique for coating in accordance with the present invention.
FIG. 11 is a fragmentary, diagrammatic sectional representation of an intermediate product achieved at the end of the processing sequence illustrated in FIG. 8.
FIG. 12 is a view similar to FIG. 11 but illustrating a fragmentary, diagrammatic sectional representation of a final product achieved at the end of the processing sequence illustrated in FIG. 9.
FIG. 13 diagrammatically illustrate sequential manufacturing steps employed in an optional mode suitable for further processing a product fabric resulting from the sequence of process steps shown in FIGS. 7, 8 and 9.
FIG. 14 is a view similar to FIG. 11 but illustrating a fragmentary, diagrammatic sectional representation of a fabric product achieved at the end of the processing sequence illustrated in FIG. 13.

An alternative mode of practicing the sequence of steps involving bilateral stretching, back coating and heating such as shown in FIG. 7 or in FIG. 9 can be accomplished in the manner shown for example, in FIG. 10. Here, fabric 71 from a pleat 72 is fed over rollers 73 and 74 onto a tanter frame 75. The fabric and pleat 72 can be considered to be either the fabric in pleat 22 or the fabric in pleat 52 except that here the fabric 71 is spatially oriented so that its pile side faces upwards, as those skilled in the art will appreciate.

After entering the tenter frame 75, the fabric 71 passes over roller coating apparatus 76 and is coated on its back side with a coating composition. Afterwards, while on the tenter frame 75, the coated fabric 71 passes through the oven 77 wherein a desired sequence of temperatures and times are employed relative to the movement of the fabric 71. After leaving the oven 77, the fabric is passed over the succession of rollers 78, 79, 80 and 81 before being stored in a pleat 82.

The coating apparatus 25, 55, and 76 are of types conventionally known to the art as are the respective ovens 26, 57, and 77.

The cross sectional appearance of fabric in pleat 46 is illustrated by the view shown in FIG. 11 where the pile 83 in a sliver knit high pile fabric 84 has been contour sheared along the curved profile 85 by passage through the contour shearing apparatus of the type, for example, illustrated in FIG. 8 with longitudinal tension being applied to the backing 86 thereof. Observe that all of the fibers in the pile 83 are more or less uniformly sheared according to the contours of the contour shearing device and that substantially no heat shrinkage of heat shrinkable fibers has yet taken place. Observe also that the individual fibers have maintained their characteristic crimp or kinky longitudinal configurations.

Referring to FIG. 12, there is seen in a cross section a representation of the appearance of a product of this invention which has undergone a heat shrinkage operation such as is achieved by passage of the fabric 51 through an oven 57. Here, the thermally stable fibers 87 maintain their same lengths as shown in FIG. 11 but the heat shrinkable fibers 88 have experienced a longitudinal shortening caused by exposure to the temperatures and times experienced in the oven 57. Observe that all fibers maintain their characteristic crimped or wrinkled configurations. The fabric of the type shown in FIG. 12 can be used as such or can be subjected to further processing operations.

The type of further processing operations to which a product fabric of this invention may be subjected, if desired, are illustrated in FIG. 13. Here, a product fabric 91 of this invention is supplied from a storage pleat 92 over a drive roller 93 and then over guide rollers 94 and 95 for passage of the pile of fabric 91 against the rotatably moving cylindrical surface portions of an electrifier roller 96, the fabric 91 being brought into face to face engagement with the electrifier roller 96 by means of support bar 97. The structure and operation of conventional electrifiers is well known to the prior art. From the region of the electrifier 96, the now processed fabric 91 is conveniently passed over a support bar 98 of a conventional shearing cylinder 99 whose function is to remove excessively long and stray hairs brought up from the pile of fabric 91 by the passage of same past the electrifier roll 96. Thereafter, the fabric 91 is passed over a guide roller 100 and then over a drive roller 101 for passing over another guide roller 102 followed by another guide roller 103 before being stored in a storage pleat 104. More than one stage of electrification followed by shearing can be employed if desired.

Referring to FIG. 14, the transverse cross sectional appearance of a fabric pleat 104 is illustrated. Here the thermally stable fibers 105 as well as the heat shrunk fibers 106 have experienced a polishing action and a straightening action upon their terminal outer regions designated as 107 and 108, respectively, for purposes of designation herein. Sometimes such a "fur polishing" action is desirable when using products of this invention, as those skilled in the art will appreciate.

Typically, the width of a starting fabric ranges from about 54 to 60 inches which is a common width in the industry. Such a starting fabric contains from about 8 to 24 wales per inch before stabilization and from about 17 to 42 courses per inch in an unstabilized condition. In a so-called "10-cut" circular knitting machine the number of courses per inch ranges from about 17 to 26 while the number of courses per inch in a so-called "16-cut" circular knitting machine ranges from about 27 to 42. After a fabric has been stabilized through a first coating operation and first heating operation while being tensioned, all as described above, a fabric contains from about 9 to 22.5 wales per inch and from about 17 to 38 courses per inch. In a so-called 10-cut machine, the number of courses per inch in stabilized fabrics ranges from about 17 to 28 while the number of courses per inch in a 16-cut machine ranges from about 27 to 44. The term "wales" has reference to stitches oriented in a longitudinal direction measured transversely, while the term courses has reference to stitches oriented in a transverse direction but measured longitudinally.

When the yarn in a starting fabric comprises polyester filament, it preferably has a denier ranging from about 200 to 600 with preferred deniers being about 300. When the yarn comprises slit film olefin, the denier preferably ranges from about 300 to 480 with most preferred deniers being about 480. When the yarn comprises a filament olefin, the denier preferably ranges from about 200 to 600. When the yarn comprises a spun staple, it has a denier preferably ranging from about 380 to 530. More preferred yarns for use in the present invention are filament olefins preferably having deniers in the range of about 25 per filament with most preferred such yarns preferably having a denier of about 250. Presently preferred olefin filament yarns, for example, have a yarn tenacity of about 6 grams per denier, an elongation at break of about 12 percent, a specific gravity of about 0.91, and about 1½ turns per inch.

When a starting fabric has no longitudinally extending pattern therein, it is preferred that such starting material contain on a 100 weight percent total pile fiber basis at least about 25 weight percent of heat shrinkable fibers which have heat shrink characteristics of at least about 20%.

At the present time, a most preferred starting fabric has a fiber to yarn weight ratio of about 9 to 1.

Preferably, in a starting fabric which (a) has been tensioned, (b) has had a first coating composition uniformly applied thereto, (c) has been heated to a temperature for a time sufficient to achieve bonding, and (d) has been tensioned, the pattern repeats thereof each have a substantially uniform width transversely, and such width of the individual patterns ranges from about 1 to 20 inches (preferably about 1 to 5 inches).

Preferably a starting fabric used in the practice of the present invention has a pile which is comprised of acrylic fibers and/or modified acrylic fibers. By the term "acrylic" and "modified acrylic" as used herein in relation to fibers, reference is had to fibers which contain bound into the polymeric structure thereof not less than about 50 weight percent of acrylic monomers. Any convenient weight ratio of acrylic to modified acrylic can be employed so long as the resulting fiber blend contains from about 10 to 90 weight percent of heat shrinkable fibers, as indicated above.

Figure 2:
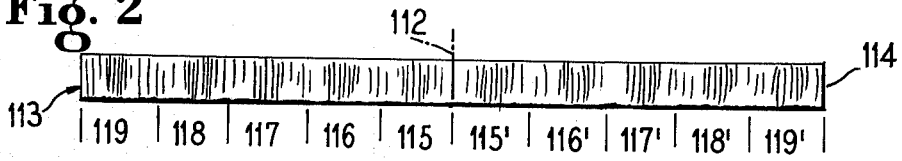
FIG. 2 is a fragmentary, sectional view taken along the line II—II of FIG. 1.

Referring to FIGS. 1 and 2, there is seen a preferred knitted pile fabric product produced by the process of the present invention. Herein, the pile thereof has the appearance of seemingly seamed together longitudinally aligned animal pelts. Each one of the pelts has a Gratzen extending longitudinally therethrough. Optionally, but preferably, the Gratzen is darker in color and thicker in texture than adjoining areas thereof. Each of the individual pelts has simulated guard hairs 110 and simulated base hairs 111 as shown in the enlarged cross sectional view depicted in FIG. 3. The product knitted pile fabric also is made according to the teachings of Kieckhefer and Grubbs preferably using a differentially transversely knitted pile fabric wherein proceeding from the center line 112 outwardly to either opposed side edge 113 or 114 thereof, the individual pattern repeats 115 through 119, and 115' through 119' are preferably in bilaterally arranged symmetrical relationship to such center line 112. Also, the individual number of wales in each of the respective pattern repeats 115 through 119 in the illustrative embodiment shown in FIGS. 1 and 2 is such that the transverse width of each individual pattern 115 through 119 is substantially equal to the others thereof. Such equality in transverse width of pattern repeats is accomplished by the use of transversely differential knitting as taught and provided in the technology contained in the above referenced copending application filed on even date herewith above referenced in the names of Kieckhefer and Grubbs.

Figure 4:
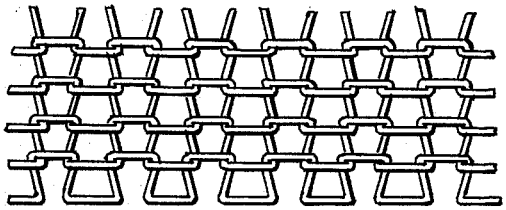
FIG. 4 is a greatly enlarged bottom plan view showing the structure of the back of the fabric of FIG. 1.

The appearance of the knitted backing characteristically involved in knitted pile fabric starting materials used in the practice of the present invention is illustrated in FIG. 4.

In preferred products of the present invention, as one proceeds across an individual pattern, there occurs a difference in the density of the pile fabric on either side of a center line of an individual pattern repeat. Thus, the fabric is denser and therefore longer in the mid region of pattern 119 than it is near the edge portions thereof in order to simulate the natural effect of a Gratzen in an animal pelt, as those skilled in the art will understand.

Figure 3:
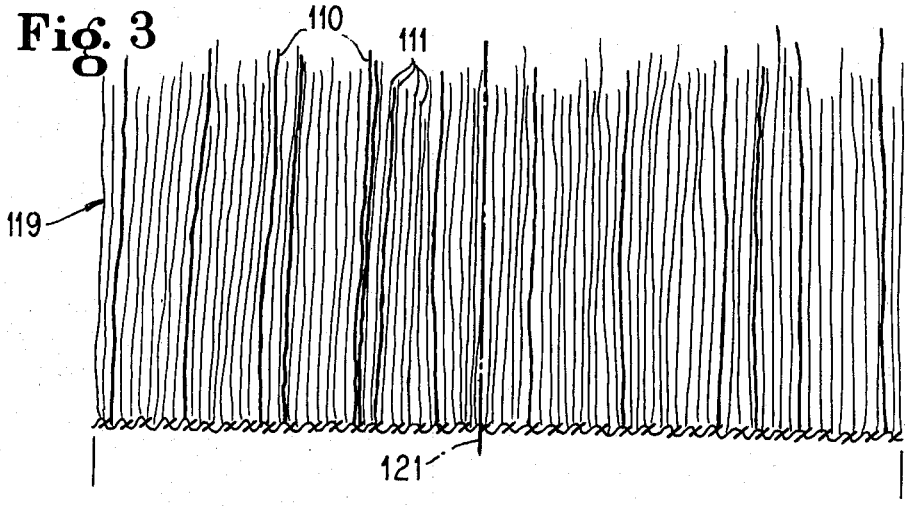
FIG. 3 is a greatly enlarged fragmentary representation of one pattern section taken along the line III—III of FIG. 1.

For example, pattern 119 shown in FIG. 3 involves an exemplary pattern wherein the guard hairs 110 are spaced at intervals from one another. In the region of the center line 121, a larger number of base haris 111 are interposed between adjacent guard hairs 110 than are interposed between adjacent guard hairs 110 at opposed side edge portions of such pattern 119.

EMBODIMENTS

The present invention is further illustrated by reference to the following examples. Those skilled in the art will appreciate that other and further embodiments are obvious and within the spirit and scope of this invention from the teachings of these present examples taken with the accompanying specification.

EXAMPLES A through E

Table II below lists various starting materials used in the following numbered examples, each one being a fabric about 60 inches wide.

Examples B, C, D and E are prepared by the teachings of the above noted Kieckhefer et al U.S. Patent application; each fabric is knitted with a pattern resembling a seemingly pelted fur of 19 pelts transversely. The number of wales per pelt is shown in Table II below.

TABLE II

| Ex. Letter | Backing yarn type | Backing yarn den. | Pile Fiber Heat Shrinkable type | Pile Fiber Heat Shrinkable length | Pile Fiber Heat Shrinkable den. | Pile Fiber Heat Shrinkable wt. % | Non Heat Shrinkable type | Non Heat Shrinkable length | Non Heat Shrinkable den. | Non Heat Shrinkable wt. % | Fabric weight ratio of fiber to yarn | Fabric wales per inch | Fabric courses per inch | Remarks |
|---|---|---|---|---|---|---|---|---|---|---|---|---|---|---|
| | STARTING FABRICS | | | | | | | | | | | | | |
| A | spun poly-ester | 380 | acry-lic | ¾ to 1½" | 3 | 75 | modified acrylic | ¾ to 1½" | 6–12 | 25 | 5:1 | 12 | 21 | solid 1 color |
| B | slit film olefin | 480 | acry-lic | ¾ to 1½" | 3 | 60 | modified acrylic | 1⅛ to 2" | 10–24 | 35 | 6:1 | 12 | 21 | animal pattern |
| | | | | | | | modified acrylic | ¾ to 1½" | 5 | 5 | | | | |
| C | fila-ment olefin | 300 | acry-lic | ¾ to 1½" | 3 | 20 | modified acrylic | 1 to 1½" | 6–18 | 40 | | | | |
| | | | | | | | modified acrylic | 1 to 1¾" | 12–24 | 40 | 5.5:1 | 12 | 21 | animal pattern |
| D | fila-ment olefin | 250 | high shrink acry-lic | ¾ to 1½" | 3 | 25 | modified acrylic | 1⅛ to 2½" | 16–24 | 40 | | | | |
| | | | | | | | acrylic | 1⅛ to 2" | 6–18 | 35 | 6:1 | 12 | 21 | animal pattern |
| E | fila-ment olefin | 250 | acry-lic | 1 to 1¾ 1½" | 3 | 15 | acrylic | ¾ to 1½ | 6 | 25 | 5.5:1 | 12 | 21 | animal pattern |
| | | | | | | | modified acrylic | 1 to 1¾ | 12 | 30 | | | | |
| | | | | | | | modified acrylic | 1 to 1½ | 18 | 30 | | | | |

TABLE III

| INCREMENT | | NO. OF WALES |
|---|---|---|
| Left Selvedge | | 28 |
| Pelt # | 1 | 38 |
| | 2 | 38 |
| | 3 | 37 |
| | 4 | 37 |
| | 5 | 37 |
| | 6 | 36 |
| | 7 | 36 |
| | 8 | 36 |
| | 9 | 35 |
| | 10 | 34 |
| | 11 | 35 |
| | 12 | 36 |
| | 13 | 36 |
| | 14 | 36 |
| | 15 | 37 |
| | 16 | 37 |
| | 17 | 37 |
| | 18 | 38 |
| | 19 | 38 |
| Right Selvedge | | 28 |
| TOTAL | | 750 |

EXAMPLES 1 through 5

The starting materials of the above Examples A through E are each employed in the practice of the present invention using conditions as specified in Tables IV and V below.

In each of these examples, the coating composition for each of the first and the second coatings comprises an aqueous, foamed emulsion of a stable self-cross linking butyl acrylate polymer composed of 89.3 weight percent butyl acrylate
8.9 weight percent acrylonitrile
1.8 weight percent N-methylol acrylomide the above percentages are derived from parts per 100 resin. This polymer has a glass transition temperature ($T_g$) of −35° C. as determined in a differential scanning colometer such as a DuPont Model 490. The polymer particle size is approximately 0.18 microns.

In the first heating or first pass the oven temperature is as shown in Tables IV and V and little curing takes place. In the second pass or second heating, as shown in Table V the higher temperature results in a substantially complete polymer cross linking.

Each of these products is contour sheared and has heat shrink heat shrinkable fibers therein.

By the term "pattern repeat" as used herein reference is had primarily to a visual effect as compared to a technical or precise fabric constructional (e.g. stitch placement) fact. For example, in the case of a seemingly pelted fabric, one selected pattern repeat transversely comprises a single animal pelt width at one transverse location when the pelt(s) adjacent such a selected pelt would achieve substantially the same aesthetic appearance with perhaps a technically different stitch pattern arrangement.

TABLE IV

| Example No. | Starting Fabric | First Tensioning (based on relaxed starting fabric) % elongation width | First Tensioning % elongation length | First coating polymer glass transition temp °C. | First coating polymer chemical type | First coating polymer weight coating lb/line yard | First Heating Temp °C. | First Heating Time min. | % shrink after first tension release width % | % shrink after first tension release length % |
|---|---|---|---|---|---|---|---|---|---|---|
| X1 | A | 10 | 8 | −30 | Acrylic | 0.13 | 240 | 3 | 1.0 | 1.0 |
| X2 | B | 8 | 9 | −30 | Acrylic | 0.16 | 230 | 4 | 1.0 | 1.5 |
| X3 | C | 10 | 8 | −30 | Acrylic | 0.18 | 250 | 2.5 | 1.5 | 1.8 |
| X4 | D | 8 | 7 | −30 | Acrylic | 0.22 | 220 | 2 | 1.3 | 1.7 |
| X5 | E | 4 | 8 | −30 | Acrylic | 0.15 | 230 | 4 | 1.0 | 1.5 |

TABLE V

| Ex. No. (contd) | Contour Shearing: *no of shear repeats transversely across fabric | Contour Shearing: shearing height (inches) | Contour Shearing: fabric speed yards per minute | Second Tensioning based on relaxed starting fabric: % elongation width | Second Tensioning based on relaxed starting fabric: % elongation length | Second Coating (Optional) polymer: glass transition temp. Tg °C. | Second Coating (Optional) polymer: chemical type | Second Coating (Optional) polymer: weight coating lb/linear yard | Second Heating: Temp. °F. | Second Heating: Time (min) |
|---|---|---|---|---|---|---|---|---|---|---|
| 1 | 20 | 15/32 | 5 | 6 | 5 | −30 | Acrylic | 0.15 | 280 | 3 |
| 2 | 12 | 1 | 7 | 5 | 6 | −30 below 0 | Acrylic | .18 | 275 | 2.3 |
| 3 | 20 | 20/32 | 6 | 7 | 6 | −30 | Acrylic | .20 | 285 | 2.5 |
| 4 | 20 | 17/32 | 5 | 5 | 4 | −30 | Arylic | .25 | 300 | 3 |
| 5 | 20 | 13/32 | 4 | 4 | 5 | −30 | Acrylic | .17 | 310 | 3.5 |

*Refers to number of groves or valleys longitudinally extending in a resulting contour sheared fabric

We claim:

1. A process for making a knitted pile fabric which has been contour sheared yet which has at least two different lengths of fibers in the pile thereof, said process comprising the steps of:

(A) tensioning both transversely and longitudinally a previously dimensionally unstabilized knitted pile starting fabric to an extent sufficient to expand the length thereof from 0 to about 30% and to change the width thereof from about −30% to +30%, said fabric being characterized by having:

(1) the backing thereof comprised of yarn having a denier ranging from about 150 to 600, (2) the pile thereof comprised of fibers extending from about ⅛ to 2 inches in height over said backing, said pile being comprised on a 100 weight percent total pile basis of from about 10 to 90 weight percent of heat shrinkable fibers, with the balance up to 100 weight percent thereof being thermally stable fibers, said heat shrinkable fibers being heat shrinkable to a heat shrinking temperature applied for a heat shrinking time, (3) a weight ratio of pile fiber to backing yarn ranging from about 2.5:1 to 16:1, (4) from about 8 to 24 wales per inch and from about 17 to 42 courses per inch, (B) uniformly applying to the surface of the backing of said fabric a first coating composition, while said fabric is so tensioned, said first coating composition comprising an organic polymeric material which:

(1) has a glass transition temperature not above about 0° C., (2) is capable of bonding to said fabric after application to said backing thereof when such are heated together to a first temperature which is below said heat shrinking temperature, (3) dimensionally stabilizes said fabric, after being heated to said first temperature for a time sufficient to achieve said bonding, to an extent sufficient to prevent said fabric from recovering from its so tensioned configuration beyond a predetermined transverse width, when said tensioning is subsequently removed, (C) heating said coated fabric backing to said first temperature for a time sufficient to achieve said bonding while said fabric is so tensioned, (D) removing said tensioning, (E) simultaneously (1) passing the resulting fabric longitudinally through a contour shearing zone extending transversely across said fabric with the pile side of said fabric being towards the contours of the shearing elements in said contour shearing zone, the transverse width of said contour shearing zone being equal to said predetermined transverse width, thereby to achieve predetermined contours in the pile of such said fabric, (2) longitudinally tensioning and transversely aligning the respective so sheared contours of said fabric with said contour shearing zone to achieve a predetermined registration between contours in said contour shearing zone and said pile, thereby to achieve a predetermined relationship between such contour in the pile side of such fabric and such fibers in the pile side thereof, and (3) contour shearing said pile of said resulting fabric, and (F) simultaneously (1) heating the so contour sheared fabric to a said heat shrinking temperature for said heat shrinking time, (2) tensioning transversely and longitudinally said so contour sheared fabric to the respective extents defined above in step (A) for said heat shrinking time, and (3) maintaining said contour sheared pile free from contact with any solid object for said heat shrinking time.

2. The process of claim 1 wherein said starting fabric has formed therein a pattern of repeats which resembles a predetermined seemingly seamed together group of longitudinally aligned animal pelts and wherein step (E) is conducted with the contours of said contour shearing zone being in a predetermined registration with said pattern of repeats.

3. The process of claim 2 wherein each of said repeats has simulated guard hairs and simulated base hairs.

4. The process of claim 2 wherein each of said repeats has a striped region of generally different color, texture, and length extending longitudinally therethrough.

5. The process of claim 4 wherein said striped region is generally darker in color and thicker in texture than adjoining areas in each individual said repeat.

6. The process of claim 1 wherein the heat shrinkable fibers of said starting fibric heat shrink at temperatures ranging from about 200° to 350° C. to the extent of from about 10 to 60 percent thereof within a heat shrinking time of from about 1 to 5 minutes.

7. The process of claim 1 wherein said starting fabric contains from about 10 to 50 weight percent of heat shrinkable fibers with the balance up to 100 weight percent thereof being thermally stable fibers.

8. The process of claim 1 wherein the pile of said starting fabric is comprised of fibers having deniers ranging from about 1.5 to 50.

9. The process of claim 1 wherein said starting fabric is comprised of at least two different classes of heat shrinkable fibers, one of said classes having a heat shrinkability in the range of from about 10 to 20 percent with deniers ranging from about 1.5 to 6, a second class of such heat shrinkable fibers having a heat shrinkability in the range of from about 18 to 35 percent and having deniers in the range of from about 3 to 12, the weight ratio of said first class of heat shrinkable fibers to said second class of heat shrinkable fibers on a 100 weight percent total heat shrinkable fiber weight basis ranging from about 4:6 to 6:4.

10. The process of claim 9 wherein said starting fabric has a plurality of pattern repeats ranging from about 10 to 200 wales each transversely and wherein step (E) is conducted with the contours of said contour shearing zone being in a predetermined registration with said plurality of pattern repeats.

11. The process of claim 10, wherein each of the pattern repeats in said starting fabric ranges from about 1 to 20 inches tranversely and each pattern has a width which is substantially equal to the others thereof, and said starting fabric has been transversely differentially knitted.

12. The process of claim 11 wherein said starting fabric has a pile which is comprised of fibers selected from the group consisting of acrylic fibers and modified acrylic fibers.

* * * * *